US008459552B2

(12) United States Patent
Arbouw

(10) Patent No.: US 8,459,552 B2
(45) Date of Patent: Jun. 11, 2013

(54) SYSTEM AND METHOD FOR THE DISPLAY OF A BALLESTIC TRAJECTORY ADJUSTED RETICULE

(75) Inventor: Paul Arbouw, Carmel, IN (US)

(73) Assignee: Awis LLC, Carmel, IN (US)

( * ) Notice: Subject to any disclaimer, the term of this patent is extended or adjusted under 35 U.S.C. 154(b) by 80 days.

(21) Appl. No.: 13/195,000

(22) Filed: Aug. 1, 2011

(65) Prior Publication Data

US 2012/0048931 A1 Mar. 1, 2012

Related U.S. Application Data

(60) Provisional application No. 61/378,363, filed on Aug. 30, 2010.

(51) Int. Cl.
*G06G 7/80* (2006.01)

(52) U.S. Cl.
USPC ..... 235/404; 235/400; 235/411; 235/414; 235/415; 235/416

(58) Field of Classification Search
USPC ..... 235/400, 404, 411, 414, 415, 416
See application file for complete search history.

(56) References Cited

U.S. PATENT DOCUMENTS

| | | | |
|---|---|---|---|
| 7,269,920 | B2 | 9/2007 | Staley, III |
| 7,292,262 | B2 | 11/2007 | Towery et al. |
| 7,421,816 | B2 | 9/2008 | Conescu |
| 7,490,430 | B2 | 2/2009 | Staley, III |

*Primary Examiner* — Kristy A Haupt
(74) *Attorney, Agent, or Firm* — Inna S. Shestul, Esq.

(57) ABSTRACT

This invention relates to a method, system and computer program product that calculates a real-time, accurate, firing solution for man carried weapon system; specifically a transparent display to be located in-line with a weapon mounted optic and a device to adjust the aim point through real-time data collection, analysis and real-time visual feedback to the operator. A firing solution system mounted on a projectile weapon comprising: A Sensor and CPU Unit (SCU) and a Sight Adjusted Reticule (SAR) and a PC Dongle which configured to facilitate communication between the SCU and a personal computer (PC), or similar computing device, enabling management of the SCU configuration and offloading of sensor obtained and system determined data values.

18 Claims, 4 Drawing Sheets

SYSTEM AND METHOD FOR THE DISPLAY OF A BALLESTIC TRAJECTORY ADJUSTED RETICULE

CROSS-REFERENCE TO RELATED APPLICATION

This application is a non-provisional application of U.S. Provisional Patent Application No. 61/378363, filed Aug. 30, 2010, entitled "System for the real time adjustment of the aim point for a designated target and display of secondary data", which is incorporated by reference herein in its entirety.

BACKGROUND OF THE INVENTION

1. Field of Invention

This invention relates to a method, system and computer program product that allows for the real-time adjustment of the sight reticule of a firearm by using a transparent display; optionally in combination with a magnified or non-magnified optic.

2. Background of Related Art

A concern, which many law enforcement, armed forces, or security personnel may encounter during a firearm confrontation, is the inability to determine with certainty where to aim/orient the weapon system in order to guarantee a fit on the target with the first shot.

At the lack of an adequate automatic weapon sighting system that would provide firing solution information to the user, currently adopted procedures in place, if any, are acquired by training relying mostly on the user's state of mind It is widely known and accepted that human beings under stressful situations react more consistently when conditioned to respond to a sensorial reference than to an adopted routine that implies analytical thought and comparison to memorized data.

Several prior art disclosures describe claims with similar intent to provide real-time firing solutions. None of the indicated related art describes the usage of an in-line, transparent, display that displays the data to the operator without impeding the usage of traditional optics or iron sights while in a non-powered state.(Staley & John R. (Dallas, Dec. 23, 2004): A device includes structure that can support the device on a weapon. One version of the device includes a first sight that facilitates weapon orientation in preparation to fire a first munition, and a second sight that facilitates weapon orientation in preparation to fire a second munition different from the first munition. A different version includes first and second sights that each facilitate weapon orientation, and an electronic control portion that is operatively coupled to and simultaneously exerts control with respect to each of the first and second sights, the first and second sights each displaying targeting information generated electronically by the electronic control portion.

U.S. Pat. No. 7,292,262 discloses that a firearm sight can detect engagement of a firing pin with a cartridge, and can respond to this event by saving an image which shows a target and reticle at a point in time just prior to the detected event. An electronic reticle can be downloaded into the sight. The effective position of the reticle within the sight can be adjusted electronically, and a zoom factor of the sight can be adjusted electronically as well. The sight can sense approximately transverse movement thereof, and can provide a user with an indication of the amount of transverse movement. With the use of an additional device, the sight can automatically align its reticle to the bore of a firearm on which the sight is mounted.

U.S. Pat. Nos. 7,490,430, 7,490,430 disclose a device can be supported on a weapon, and has a range portion that specifies a range to a target, a sensor portion that provides sensor information representing an orientation of the device; and a sight that facilitates weapon orientation in preparation to fire the munition. The device has an electronic control portion responsive to sensor information from the sensor portion and a range from the range portion for calculating how to hit a target with a munition, and for causing the sight to present a visual indication of how to orient the weapon so that the munition will hit the target, the electronic control portion terminating the presentation of the visual indication by the sight in response to a lack of user activity for a selected time interval during the presentation of the visual indication.

U.S. Pat. No. 7,421,816 discloses an invention that includes a sighting system for use with a firearm that has a telescopic sight, a laser rangefinder for providing the distance to the target, device(s) for receiving various inputs, a computing system that calculates the point of aim of the firearm's projectile based upon the input(s) and the calculated distance to the target, and a display means that provides an image of the computed point of aim within the telescopic sight's field of view.

Ballistic trajectory calculators of convention art rely on the manual input of data, or acquisition of data via attached sensors. Once a firing solution is calculated, the operator needs to manually act upon that data with their scope/firearm orientation.

SUMMARY OF THE INVENTION

The presented invention is related to a system, method and computer program product that provides a real-time, accurate firing solution for the specific weapon system and sighting optic that the invention is attached to. The invention provides this functionality without impeding the function of the weapon system or scope. Secondary functionality may be found in data logging of weapon system usage, environmental data and any and all other functions not yet determined but associated either directly or indirectly with the operating of a weapon system equipped with the system as described in the claim.

The system consists of a transparent display and a method for processing a variety of sensor inputs including, but not limited to: GPS, Barometric pressure meter, (Laser) range finder, Optic Magnification Factor, Wind direction, Wind Speed and Configuration data including, but not limited to: Caliber, Load (powder grains), Barrel length, weapon system orientation along 3 axis.

The system is designed to predominantly function within an environment with an ambient operating temperature between −40° C. and +85° C.; more extreme conditions may be possible to be serviced with specific configurations of the system described in the claim. The system is designed to be moisture resistant and possibly submersible under certain configurations of the system described in the claim.

Configuration data is combined with sensory input in order to adjust the position of the reticule so the fired projectile will impact the target at the place of measurement as determined by the range measurement data.

The transparent display is located between the eye of the operator and the optic on the top of the weapon system. When the system is not activated, the operator can use the optic by looking through the transparent display and using the optic in a traditional fashion.

The transparent display unit is mounted using a solid semi-permanent or quick release mounting solution to a standard MIL-STD-1913 Picatinny rail or other attachment means as specific to the top of the intended host weapon system.

The configuration of the display and central processor consists of small size printed circuit board(s) (PCB) with amongst it various electronics components and sensors, a power source and a low-power consumption transparent display means. The electronics will be located inside a housing (polymer or other suitable material), providing protection from environmental elements and providing a means of attachment to the mounting solution.

The system operates at low voltage, conserving energy for a long duration operational time.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENT

Reference will now be made in detail to the preferred embodiments of the present invention, examples of which are illustrated in the accompanying drawings.

The Sight Adjusted Reticule (SAR) consists of a mounting solution and frame to house the transparent display. The housing and display are provided with power and a display signal either via a physical connection to the Sensor and CPU Unit (SCU) or an independent (integrated) power source and wireless data-display connection.

Figure 1:
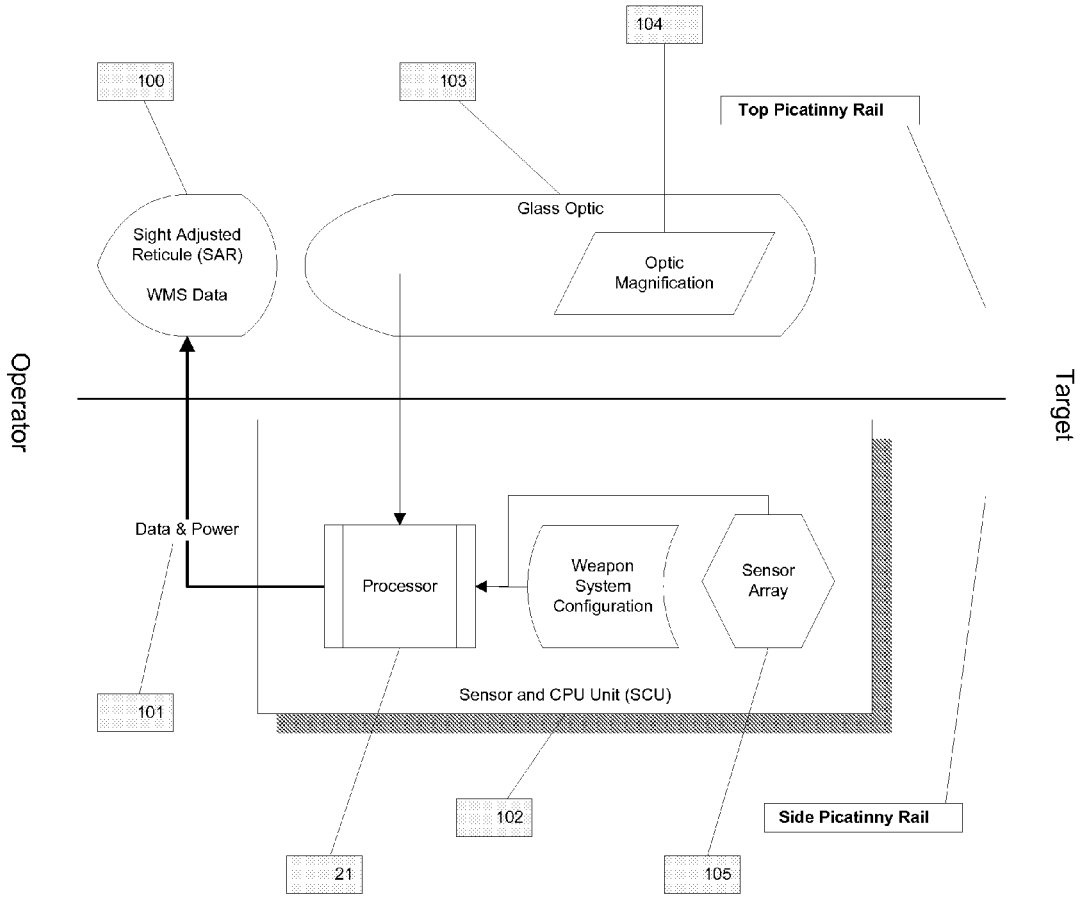
FIG. 1 shows one exemplary Ballistic Trajectory Aiming Adjustment system in accordance with a preferred embodiment as positioned in relation to the optic.

FIG. 1 shows one exemplary Sight Adjusted Reticule (SAR) 100 in accordance with the preferred embodiment. The SAR is attached to the top (12 o'clock) Picatinny/accessory rail, in front of any glass optic 103 that might be attached to the weapon system. In one exemplary configuration, data and power are provided to the SAR 100 via a wired connection 101 between the SAR and the Sensor and CPU Unit (SCU) 102. The SCU 102 also contains configuration information for the system and processes inputs from either integrated (or external) sensor suites 105 and current optic magnification levels 104 in order to provide the most accurate reticule adjustment for the specific weapon system and environmental conditions/variables. Depending on the initiating actions and provided data, the SAR 100 calculates the Firing Solution (FS)

In the SCU 102, a power source, best suited to the system configuration and client mission requirements, is located. This may either be a disposable power source or a power source with wireless charging capability.

The Sensor Array 105 illustratively shown in FIG. 1 may contain a multitude of sensory input similar to the sensor suite as described in patent application Ser. No. 12/719,839 entitled "System and Method for the Remote Measurement of the Ammunition Level, Recording and Display of the Current Level". The Sensor Array 105 may include, but is not limited to, longitude/latitude, ambient temperature, cardinal location, humidity, barometric pressure, g-load shocks and any other environmental data to the weapon system.

Initially the SAR 100 and the SCU 102 are in deep sleep mode. After manually, or automatically via sensory input, turning on the SCU 102, the SCU 102 boots up and collects sensory inputs. Upon successful completion of the data collection, the SCU transfers the firing solution (FS) to be displayed on the SAR 100 via either a physical connection or a wireless connection 101 between the SCU 102 and the SAR.100

In order to calculate the Firing Solution, the following data may be collected (other data may be required depending on the weapon system and/or ammunition used) for example, the Scope (3-12×42) with magnification minimum and maximum (i.e. 3-12) with bell housing size front (i.e. 42), with bell housing size rear (i.e. 15) and current magnification setting (i.e. 5). The weapon information such as a barrel length (i.e. 16 inches) and a barrel twist (i.e. 1 in 9). The ammunition information such as a caliber (i.e. 5.56), a bullet type (i.e. Full Metal Jacket), a bullet weight (i.e. 62 gr), a ballistic coefficient (i.e. 0.255), a powder charge (i.e. 58.5 gr) and a muzzle velocity (i.e. 3240 fps). And environment information such as a cross wind (i.e. 10 mph), a wind direction (i.e. as relative to the orientation of the weapon system), a barometric pressure (i.e. 29.10 inHg), an altitude (i.e. 1500 ft) and a temperature (i.e. 75F). The weapon orientation such as a cardinal direction (i.e. 48 degrees), an incline (i.e. 56 degrees), a cant (i.e. 20 degrees), and a GPS location (i.e. Longitude: 23.45833° E., Latitude: 48.8583° N.). The target data such as for example distance to target (i.e. 352 yards).

The process of determining a firing solution is started by the action of taking a laser range finding reading to determine the distance to target or by manually entering the distance to target. The collection/entry of this data starts the collection cycle of both environment and weapon-orientation data. Environment data could be pulled from a repository of historic data based upon the GSP location of the weapon system. Historic data includes, but is not limited to, prior readings as taken by the system. Utilizing prior collected data for limited-variability data (like temperature, barometric pressure etc) will cause minimal negative impact on the firing solution (FS) because the data does not change from shot-to-shot. The utilization of historic data for temperature, barometric pressure etc also allows for a faster turnaround time of the FS calculation due to the reduced time of sensor data collection. A software configurable interval for environmental data collection is used by the system and can be changed by the user.

Based on the collected and retrieved data regarding the target, environment, weapon and scope, a calculation is performed that adjusts the aim-point 301 (FIG. 3) in the SAR 100 from the calibrated center, to the correct aim-point in order ensure a direct hit on the intended target at the measured range under the environmental conditions and weapon orientation as determined by the data collection cycle.

Figure 2:
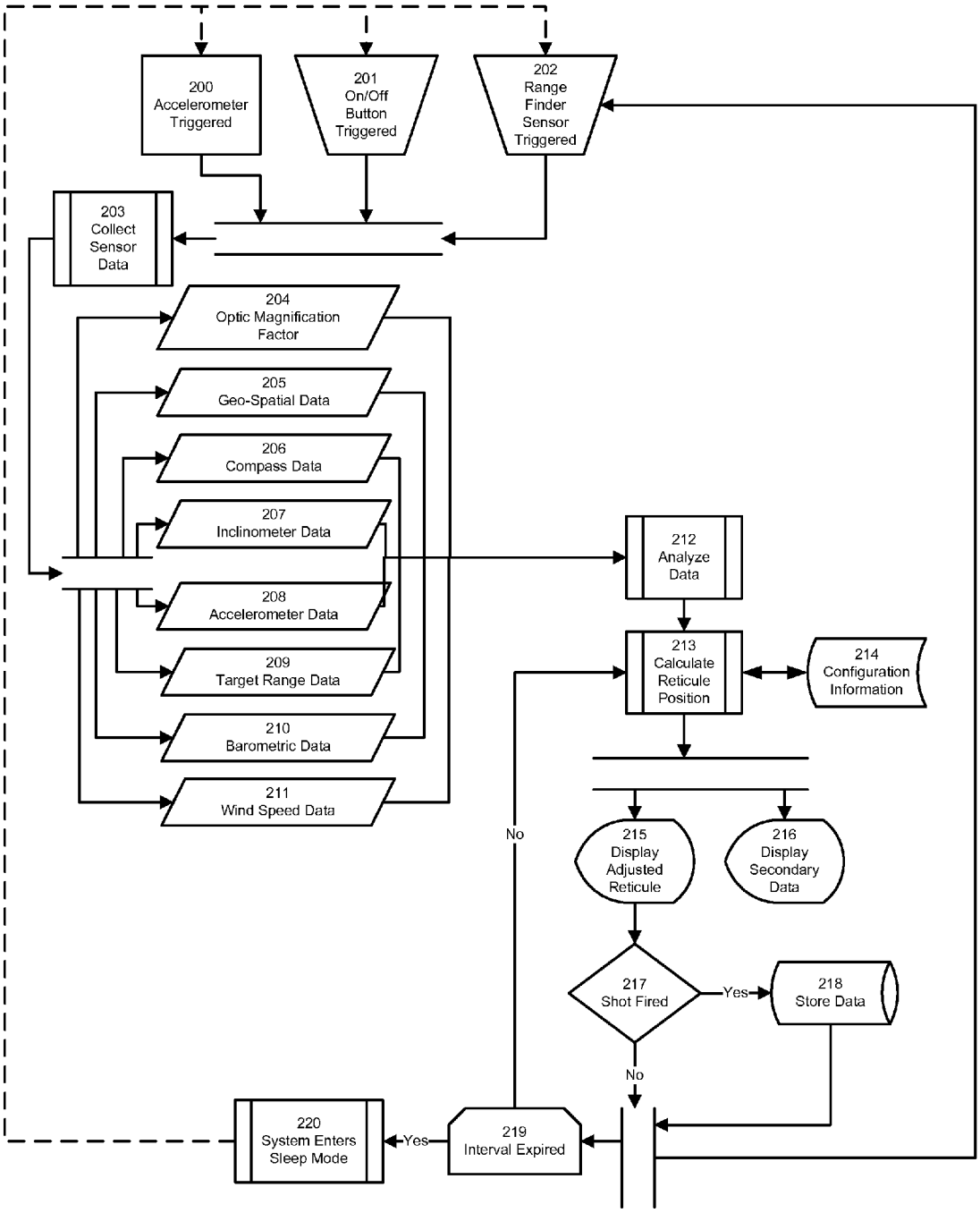
FIG. 2 is a flowchart of method for processing sensor input resulting in the display of an adjusted sight reticule and/or other processed information.

Upon the recorded discharge of the weapon, based on either a recorded g-load shock and/or in combination with a recorded sound wave, the aim-point 301 will return to the calibrated center of the SAR once either a configured interval expires 220 (FIG. 2) , or a new distance to target is recorded/entered 202 (FIG. 2). During the interval, the aim-point will be adjusted to compensate for the movement of the weapon system, allowing for fast and accurate follow-up shots.

The calibrated center of the SAR 100 is in line with the center crosshair of the scope that is sits in front of. The center of the SAR 100 can also be the calibrated zero for the weapon system if the SAR 100 is used as the stand-alone sighting system for the weapon.

The FS process is repeated when a new laser range finding is taken, or a new distance to target is entered.

Depending on the implementation of the system, the SAR 100 can also display additional data including (but not limited to): battery status, ammunition left in the magazine attached to the weapon system, environment data as collected by the system (temperature, altitude, etc), and system configuration settings.

After a configured interval 220 of inactivity from either user- or sensor input or a CPU 21 command, the SCU 102 goes back to deep sleep mode 221. When the SCU 102 receives a sensory value, it uses the provided information and calculates the correct aim-point for the current firing solution and updates the reticule on the display 100. Upon completion of this process the SCU goes to sleep mode waiting for a timer interrupt, or any other input method restarting the sensory data analysis process.

SCU/SAR uses a removable (disposable/rechargeable) power source consisting of commercially available or equivalent batteries.

The display 100 is mounted facing towards the operator and in line with the optics mounted on the weapon system Mounting solution that allows the SCU and SAR to be mounted on a MIL-STD 1913A Picatinny rail or other weapon system standard accessory rail.

External to the SCU housing, a Human interface to manipulate SCU settings and manual trigger sensory data collection cycle.

Within the SCU, a Multi-axis MEMS sensor is used to determine the orientation of the host weapon system along 3 dimensions.

Optional within the SCU, a multi-antenna array used to facilitate wireless communication between the SCU and the SAR and/or SCU and optional sensor array 105.

Depending on the optic used on the host weapon system, magnification setting 104/204 is transferred to the SCU as a variable in the firing solution calculation.

Within the SCU, additional data analysis, processing and storage may be added to provide additional functionality in specific configurations.

FIG. 2 is a flowchart of method for determining the appropriate aim-point based upon configuration and sensory data as collected by the system.

The SCU 102 is woken up from a deep sleep mode by either an automated trigger or manual trigger as indicated in Steps 200, 201, or 202.

The SCU system polls the various input sensors and collects their readings in parallel in Step 203.

The (optional) sensor array within the SCU 102, or integrated into third party support devices, might provide sensory data as indicated in Steps 204, 205, 206, 207, 208, 209, 210 and 211.

In Step 212 data is analyzed and prepared for utilization in the calculation of the position of the sight reticule within the SAR 100.

In Step 213 the SCU 102 calculates the adjusted sight reticule based upon the provided sensor data and system configuration data 214.

In Step 214 SCU 102 provides system configuration information (for example the caliber or barrel length as used in the host weapon) to the firing solution calculation process 213.

In Step 215 the results of the firing solution calculation are displayed on the display of the SAR 100.

In Step 218 all prepared sensory data and the results of the firing solution calculation are stored in the SCU 102 upon the detection of a shot fired.

The SCU continues to adjust the SAR aim-point 301 until either a predefined interval expires or a new distance-to-target reading is obtained/entered.

If the predefined interval expires 219, the system places itself in sleep mode to conserve power until a new cycle is triggered.

Figure 3:
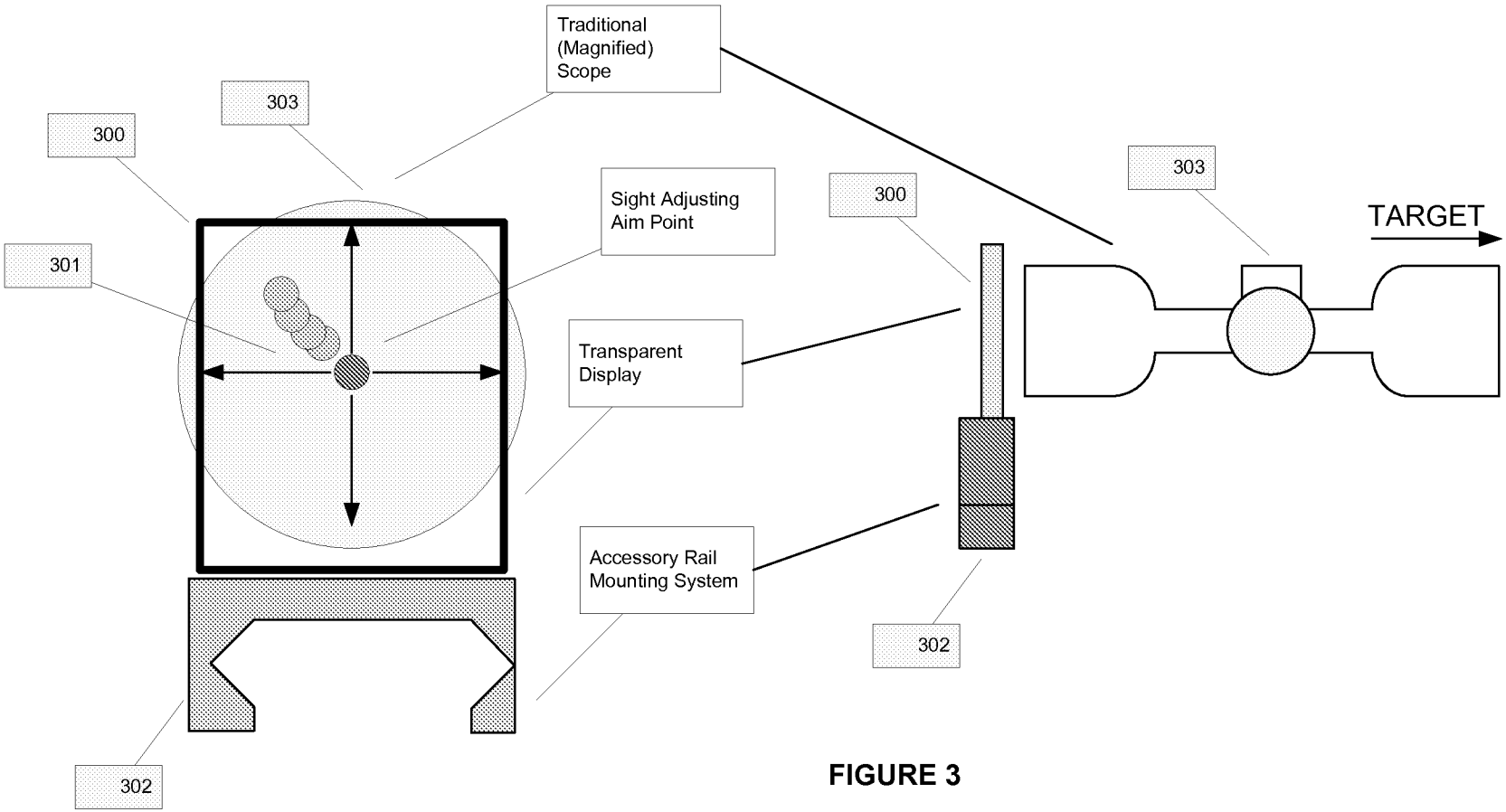
FIG. 3 shows one exemplary Ballistic Trajectory Aiming Adjustment system with adjusting reticule in accordance with the preferred embodiment.

FIG. 3 shows an exemplary sight adjusted reticule (SAR) 300 in accordance with the preferred embodiment. The transparent display 300 is attached to a mounting solution 302 that allows the SAR 300 to be attached to a MIL-STD 1913A Picatinny rail or other weapon system standard accessory rail.

From the configured center (zeroed) point, the Reticule Aim Point 301 adjusts its position within the display 300 based upon the firing solution (FS) 213 as calculated by the system.

The SAR 300 and SAR based mounting solution 302 are positioned in line with a traditional optic 303. The SAR 300 is positioned on the operator's side of the optic.

If the optic is a magnified optic, the magnification setting can be incorporated into the firing solution either via manual input or via a sensor attached to the scope magnification dial.

Figure 4:
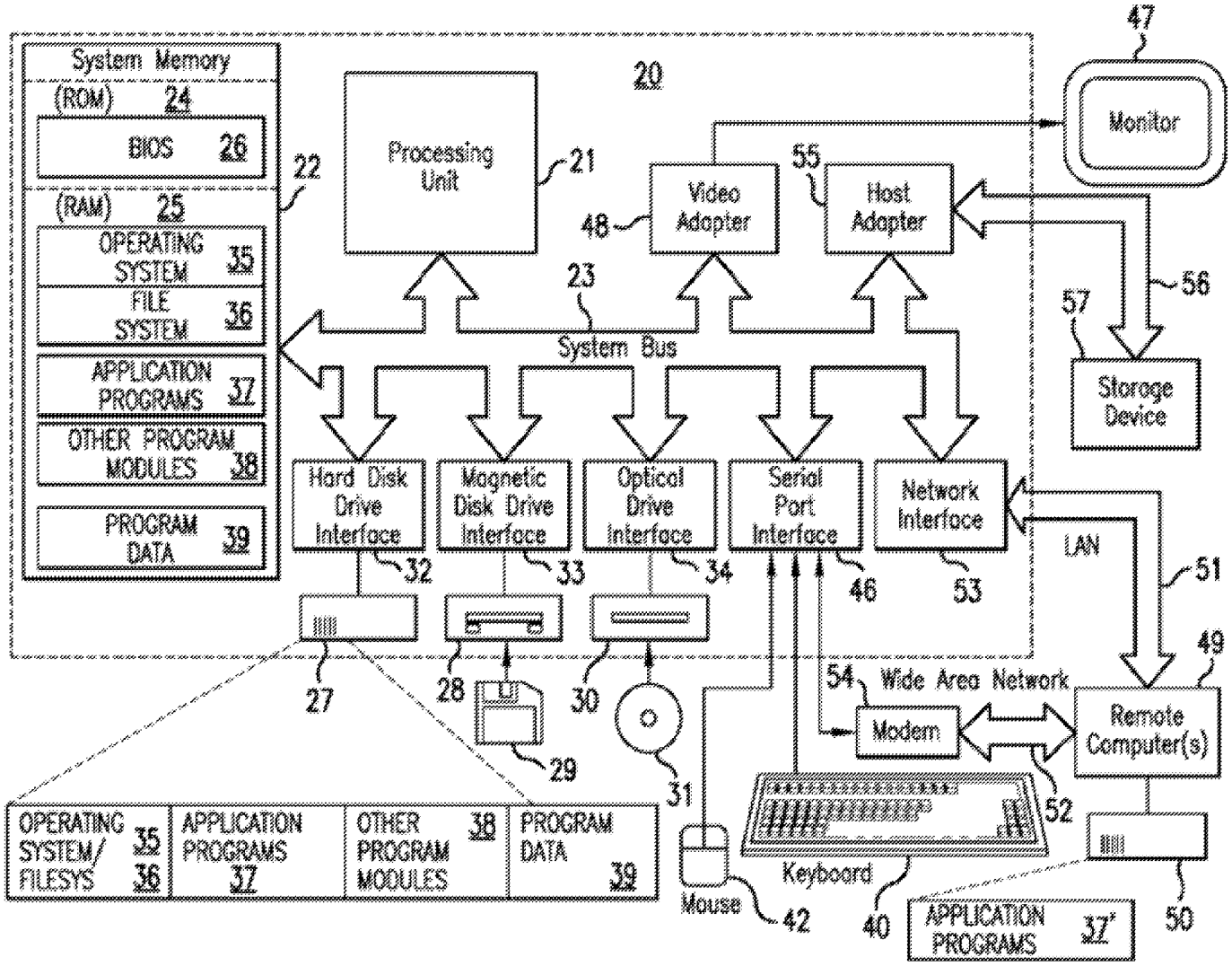
FIG. 4 is an example of the computing system where the preferred embodiment may be implemented.

With reference to FIG. 4, an exemplary system for implementing the preferred embodiment includes a general purpose computing device in the form of a personal computer or server 20 or the like, including a processing unit 21, a system memory 22, and a system bus 23 that couples various system components including the system memory to the processing unit 21. The system bus 23 may be any of several types of bus structures including a memory bus or memory controller, a peripheral bus, and a local bus using any of a variety of bus architectures. The system memory includes read-only memory (ROM) 24 and random access memory (RAM) 25. A basic input/output system 26 (BIOS), containing the basic routines that help to transfer information between elements within the personal computer 20, such as during start-up, is stored in ROM 24. The personal computer 20 may further include a hard disk drive 27 for reading from and writing to a hard disk, not shown, a magnetic disk drive 28 for reading from or writing to a removable magnetic disk 29, and an optical disk drive 30 for reading from or writing to a removable optical disk 31 such as a CD-ROM, DVD-ROM or other optical media. The hard disk drive 27, magnetic disk drive 28, and optical disk drive 30 are connected to the system bus 23 by a hard disk drive interface 32, a magnetic disk drive interface 33, and an optical drive interface 34, respectively. The drives and their associated computer-readable media provide non-volatile storage of computer readable instructions, data structures, program modules and other data for the personal computer 20. Although the exemplary environment described herein employs a hard disk, a removable magnetic disk 29 and a removable optical disk 31, it should be appreciated by those skilled in the art that other types of computer readable media that can store data that is accessible by a computer, such as magnetic cassettes, flash memory cards, digital video disks, Bernoulli cartridges, random access memories (RAMs), read-only memories (ROMs) and the like may also be used in the exemplary operating environment.

A number of program modules may be stored on the hard disk, magnetic disk 29, optical disk 31, ROM 24 or RAM 25, including an operating system 35 The computer 20 includes a file system 36 associated with or included within the operating system 35, such as the Windows NT™ File System (NTFS), one or more application programs 37, other program modules 38 and program data 39. A user may enter commands and information into the personal computer 20 through input devices such as a keyboard 40 and pointing device 42. Other input devices (not shown) may include a microphone, joystick, game pad, satellite dish, scanner or the like. These and other input devices are often connected to the processing unit 21 through a serial port interface 46 that is coupled to the system bus, but may be connected by other interfaces, such as a parallel port, game port or universal serial bus (USB). A monitor 47 or other type of display device is also connected to the system bus 23 via an interface, such as a video adapter 48. In addition to the monitor 47, personal computers typically include other peripheral output devices (not shown), such as speakers and printers.

The personal computer 20 may operate in a networked environment using logical connections to one or more remote computers 49. The remote computer (or computers) 49 may be another personal computer, a server, a router, a network PC, a peer device or other common network node, and typically includes many or all of the elements described above relative to the personal computer 20, although only a memory storage device 50 has been illustrated. The logical connections include a local area network (LAN) 51 and a wide area network (WAN) 52. Such networking environments are commonplace in offices, enterprise-wide computer networks, Intranets and the Internet.

When used in a LAN networking environment, the personal computer 20 is connected to the local network 51 through a network interface or adapter 53. When used in a WAN networking environment, the personal computer 20 typically includes a modem 54 or other means for establishing communications over the wide area network 52, such as the Internet. The modem 54, which may be internal or external, is connected to the system bus 23 via the serial port interface 46. In a networked environment, program modules depicted relative to the personal computer 20, or portions thereof, may be stored in the remote memory storage device. It will be appreciated that the network connections shown are exemplary and other means of establishing a communications link between the computers may be used.

Having thus described a preferred embodiment, it should be apparent to those skilled in the art that certain advantages of the described method and apparatus have been achieved. It should also be appreciated that various modifications, adaptations, and alternative embodiments thereof may be made within the scope and spirit of the present invention. The invention is further defined by the following claims.

What is claimed is:

1. A system for the calculation of continuous a real-time firing solution and aim point adjustment, providing a visible readout to the weapon operator, optionally in line with (before or after), and possibly preceding, a (non-) magnified scope, the system comprising:

a transparent display for the display of a Sight Adjusted Reticule (SAR), displaying both a sensory input corrected aim point for the intended target and the display of secondary data as collected by/available to the system;

a Sensor and a CPU Unit (SCU), which includes at least one sensor that automatically turns on the system and obtains a reading from the sensory inputs, a storage means that stores the data obtained, a CPU which is configured to calculate and store a firing solution based upon the collected sensory data and a wired or wireless connection to the display (SAR) that provides a visualization of the firing solution, as calculated by the SCU based on the collected data and SCU configuration data, and provides a visible interface to configure the system settings; and a wired or wireless communication means, enabling management of the SCU configuration and offloading of sensor obtained and system determined data values;

wherein upon a recorded discharge of the weapon, or other system trigger event, a distance to target is recorded and an aim point displayed in relation to a calibrated center of the SAR and with the aim point being continuously adjusted for The distance target and real time orientation along multi-axis.

2. The system of claim 1, wherein the SCU further comprising a means that determines the orientation and environment of the weapon system and the distance to the intended target via input from a third party sensor suite or manual input.

3. The system of claim 2, wherein the firing solution is displayed in front of a traditional, magnified or non-magnified scope without interfering with the normal operation of the reqardless of the SAR being in a powered state.

4. The system of claim 2, wherein the SAR is positioned after a traditional, magnified or non-magnified, scope without interfering with the normal operation of the scope regardless of the SAR being in a powered state.

5. The system of claim 1, wherein the SCU remotely and either wired or wirelessly controls the SAR central processor and overall power state of the SAR.

6. The system of claim 1, wherein the SAR further comprises: a housing containing electronic components, the transparent display capable of displaying a firing solution corrected aim point and any secondary data as available in the system, and a mounting solution allowing the attachment to a MIL-STD 1913A Picatinny rail or other weapon system standard accessory rail.

7. The system of claim 6, wherein the transparent display of the SAR comprises a transparent LCD type display, capable of providing interactive information through a transparent LCD surface glass.

8. The system of claim 1, wherein the SAR and SCU are optionally combined into a single housing and mounting solution.

9. The system of claim 1, wherein the SCU further comprises a laser range finder for the determination of the distance to an intended target or a connection to a third party device providing distance-to-target data.

10. The system of claim 1, wherein the SCU further comprises the central processing unit (CPU) that upon detection of a sensory input from the laser range finder, or another distance-to-target source, powers up the system and calculates a firing solution based upon all available sensory and system configuration data.

11. The system of claim 1, wherein the SCU further comprises of user interface buttons to both navigate the settings of the system as well power up the system and trigger a signal for the collection of distance-to-target data, and other weapon system environmental, variables.

12. The system of claim 1, wherein the SAR further comprises of user interface buttons to both navigate the settings of the system as well power up the system and trigger a signal for the collection of distance-to-target data, and other weapon system environmental, variables.

13. The system of claim 1, wherein the SCU further comprises a wired and/or wireless interface to allow data transfer from the storage to a computer or other data collection device.

14. The system of claim 1, wherein a multi-angle reading is provided to the SCU via a multi-axis MEMS or other type multi-directional sensor within the SCU.

15. The system of claim 1, where the fire solution presentation is adjusted for the level of magnification as set on the traditional optic that may be mounted in line with the SAR.

16. The system of claim 1, where the fire solution presentation is adjusted, as appropriate, for the dimension of either the ocular lens or objective lens on the traditional optic in line with the SAR.

17. A method fort continuous the real-time calculation of a firing solution for a configured caliber, other system supporting data, and measured distance-to-target and providing a visible readout to the weapon operator in line with a weapon optic, the method comprising:

configuring a Sensor and CPU Unit (SCU) to communicate with a transparent display displaying a Sight Adjusted Reticule (SAR), the SCU includes at least one sensor that automatically turns on the system and wakes up the SAR and obtains a reading from the sensor array, including distance-to-target data, (possibly in combination with data provided from a data repository containing prior sensory input and fire solution data) a storage means that stores the readings obtained from the sensor array and the transparent display that provides a read-out of the firing solution, as calculated by the SCU based on the sensor provided and configuration data, and provides a visible interface to configure the system settings; and configuring a PC Dongle to facilitate communication between the SCU and a personal computer (PC) or similar computing device, enabling management of the SCU configuration and offloading of sensor obtained and system determined data values;

wherein upon a recorded discharge of the weapon, or other system trigger event, a distance to target is recorded and an aim point displayed in relation to a calibrated center of the SAR and with the aim point being continuously adjusted for the distance target and real time orientation along multi-axis.

18. A non-transitory computer useable storage medium having computer executable program logic stored thereon for executing on a processor, the program logic implementing the steps of claim 17.

* * * * *